US008292793B2

(12) United States Patent
Ryu et al.

(10) Patent No.: US 8,292,793 B2
(45) Date of Patent: Oct. 23, 2012

(54) CONTROL METHOD OF AUTOMATIC BALANCING CENTRIFUGE USING BALANCER

(75) Inventors: Heuigeun Ryu, Yangcheon-gu (KR); Jong-Mok Lee, Guro-gu (KR); Sungha Chang, Jongno-gu (KR)

(73) Assignee: Hanlab Corporation, Paju-si, Gyeonggi-do (KR)

( * ) Notice: Subject to any disclaimer, the term of this patent is extended or adjusted under 35 U.S.C. 154(b) by 606 days.

(21) Appl. No.: 12/533,155

(22) Filed: Jul. 31, 2009

(65) Prior Publication Data

US 2010/0069216 A1 Mar. 18, 2010

(30) Foreign Application Priority Data

Sep. 16, 2008 (KR) ..... 10-2008-0090570

(51) Int. Cl.
*B04B 9/14* (2006.01)

(52) U.S. Cl. ..... 494/37; 494/82

(58) Field of Classification Search ..... 494/1, 10, 494/12, 16–21, 33, 82, 84; 73/457–458; 210/85, 144; 68/23.1, 23.2; 74/570.2, 571.1, 74/572.4

See application file for complete search history.

(56) References Cited

U.S. PATENT DOCUMENTS

| | | | | |
|---|---|---|---|---|
| 1,254,694 | A * | 1/1918 | Humphries | 74/570.2 |
| 3,692,236 | A * | 9/1972 | Livshitz et al. | 494/20 |
| 5,715,731 | A * | 2/1998 | Koch | 74/572.4 |
| 5,768,951 | A * | 6/1998 | Hannah et al. | 74/570.2 |
| 5,816,115 | A * | 10/1998 | Taylor et al. | 74/570.2 |
| 5,829,318 | A * | 11/1998 | Hannah et al. | 74/570.2 |
| 6,116,112 | A * | 9/2000 | Sohn | 74/570.2 |
| 6,132,354 | A * | 10/2000 | Ohtsu et al. | 494/16 |
| 7,435,211 | B2 * | 10/2008 | Kim et al. | 494/82 |
| 7,942,801 | B2 * | 5/2011 | Ryu et al. | 494/82 |
| 2004/0003678 | A1 * | 1/2004 | Neubauer et al. | 74/573 R |
| 2007/0225143 | A1 * | 9/2007 | Kim et al. | 494/82 |
| 2010/0009835 | A1 * | 1/2010 | Ryu et al. | 494/82 |
| 2010/0069216 | A1 * | 3/2010 | Ryu et al. | 494/37 |

FOREIGN PATENT DOCUMENTS

| | | | |
|---|---|---|---|
| JP | 11156243 | A * | 6/1999 |
| RU | 2210014 | C2 * | 8/2003 |
| WO | 98/01733 | A1 * | 1/1998 |
| WO | 00/29122 | A1 * | 5/2000 |

* cited by examiner

*Primary Examiner* — Charles E Cooley
(74) *Attorney, Agent, or Firm* — Drinker Biddle & Reath LLP

(57) ABSTRACT

The present invention relates to a control method of a centrifuge using balancer wherein a balancer containing balls, a liquid, or both balls and a liquid are provided, thereby helping the rotor rotate more stably. More particularly, the centrifuge comprises a motor, a rotational shaft of the motor projected from said motor, a rotor, a main body, and a balancer which contains compensation material in a balancing space formed by a cover that is coupled to said main body, wherein the balancing for the unbalance due to the loaded samples is executed more accurately and stably.

8 Claims, 11 Drawing Sheets

CONTROL METHOD OF AUTOMATIC BALANCING CENTRIFUGE USING BALANCER

NAMES OF PARTIES TO JOINT RESEARCH AGREEMENT

The present application was prepared pursuant to a joint research agreement within the meaning of 35 U.S.C. §103(c), under Gyeonggi-do Technology Development Business between Gyeonggi Institute of Science & Technology Promotion and the Gyeonggi Provincial Government.

BACKGROUND OF THE INVENTION

1. Field of the Invention

The present invention relates to a control method of a centrifuge using a balancer, more particularly a control method that helps the rotor rotate more stably and thus improve the lifetime of the centrifuge by controlling the rotation of the rotor in such a way that the unbalance due to the weight of the samples is compensated accurately and stably when centrifugating the samples loaded in the rotor using the balancer containing balls, a liquid, or both balls and a liquid, thereby reducing the vibration due to the unbalance.

2. Description of the Related Art

In general, by introducing the centrifugal force, instead of gravity, to particles in suspension or substances dissolved in a liquid medium, the sedimentation phenomenon can be accelerated and this process is called centrifugation.

The centrifuge that is used in such a centrifugation is a device employing the principle that the particles of high density contained in suspension tend to migrate to the edge by centrifugal force while the particles of low density tend to gather toward the center, and its general configuration is illustrated in FIGS. 1*a* and 1*b*.

As illustrated in FIGS. 1*a* and 1*b*, the general centrifuge has a cushioning member such as vibration-proof rubber or a damper installed to a supporting plate formed at the inner surface of the case, and a bracket or supporting plate installed on the top of said cushioning member. It is a general configuration to install a motor to said bracket or supporting plate, and mount a rotor to the rotating shaft projected from said motor.

This centrifuge uses different types of rotor, depending on its use; a swing-out rotor type rotating perpendicularly to the rotating shaft of the motor and a fixed angle type with cavities rotating at a predetermined angle provided therein.

As the motor rotates at a high speed, exerting a strong centrifugal force to the samples in the bottles or the test tubes which arc disposed inside a horizontal or fixed angle rotor, the centrifuge separates the substances contained in the samples by the difference in the centrifugal forces due to the differences in density. A strong centrifugal force must be exerted to the samples for the separation of the substances in the samples, and in order to apply a strong centrifugal force to the samples, generally the rotor must rotate at a high speed and vibration must not be generated particularly during the high-speed rotation of the rotor.

However, in the process of the high-speed rotation of a centrifuge, vibration is generated by a combination of different causes; deflection motion of the rotating shaft of the motor, whirling motion due to the unbalance of the rotor weight, and other external factors. Among these causes of vibration, the most common cause is the whirling motion due to the unbalance of the rotor weight.

Therefore, for the centrifuge without a balancer, to remove the unbalance that occurs due to the differences in the number or weight of the samples disposed in the rotor, the operator should separately measure the weights of the samples before the operation of centrifugation and remove the differences in weight between the samples before rotating the rotor, which causes an inconvenience in operation.

If the unbalance of weight between the samples occurs, the vibration is generated in the process of centrifugation, causing the problems that the substances in the samples are not separated or even if they had been separated, the separated substances could be remixed with vibration. Furthermore, noise is generated in the process of centrifugation by said vibration.

The centrifuge has a problem in that the action of force and moment due to the unbalance of weight between the samples could cause an excessive vibration in the process of centrifugation, causing a failure of the centrifuge itself. In order to solve those problems of noise and vibration generated in the process of centrifugation, a cushioning member such as a damper or rubber was installed, but had a shortcoming that it did not sufficiently absorb the noise and vibration. Therefore, a centrifuge using a balancer containing balls was suggested in order to solve the problems of noise and vibration caused by the unbalance of weight between the samples.

The ball balancer illustrated in FIGS. 3*a* and 3*b* is configured to have compensation material installed inside the case (130) which is formed with a balancing space of an annular shape, wherein a shaft hole (105) through which a rotating shaft of the motor is fixedly coupled is formed in the center of the balancer.

The ball balancer configured as above is provided with balls to an extent of occupying a portion of the balancing space (150) which is formed inside the case (130), and has an advantage that when the rotational speed of the motor (not shown) exceeds the resonant speed, the balls move to an opposite direction to the weight unbalance position, thereby balancing the rotor (not shown) and stabilizing the rotation.

However, it has a drawback that often times an accurate balancing could not be achieved due to various factors such as the vibration characteristics of the system, the initial location of balls, the internal friction of the balancer, etc., and in this ease, the high-speed rotation of the rotor could cause strong vibration and noise, resulting in the safety-related accidents.

SUMMARY OF THE INVENTION

It is an object of the present invention to provide a control for a centrifuge using a balancer in order to solve the problem of excessive vibration that can be generated when the compensation for the unbalance is not achieved accurately or the compensation material is moved irregularly due to the system damage during the high speed rotation of the rotor or by the action of external forces. In other words, the object of the present invention is to smoothly control the balancer containing balls, a liquid, or both balls and a liquid which provides an automatic balancing even in case the operator did not accurately adjust the weights of the samples before loading.

The above and other objects can be accomplished by the provision of a centrifuge using a balancer, wherein the control comprises a step to accelerate beyond the resonant speed where the balancing is achieved, a step to measure the vibrational acceleration, a step to judge whether or not the acceleration is possible, and a step to decelerate below the resonant speed, in addition to the basic control that accelerates to the target rotational speed.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1A:
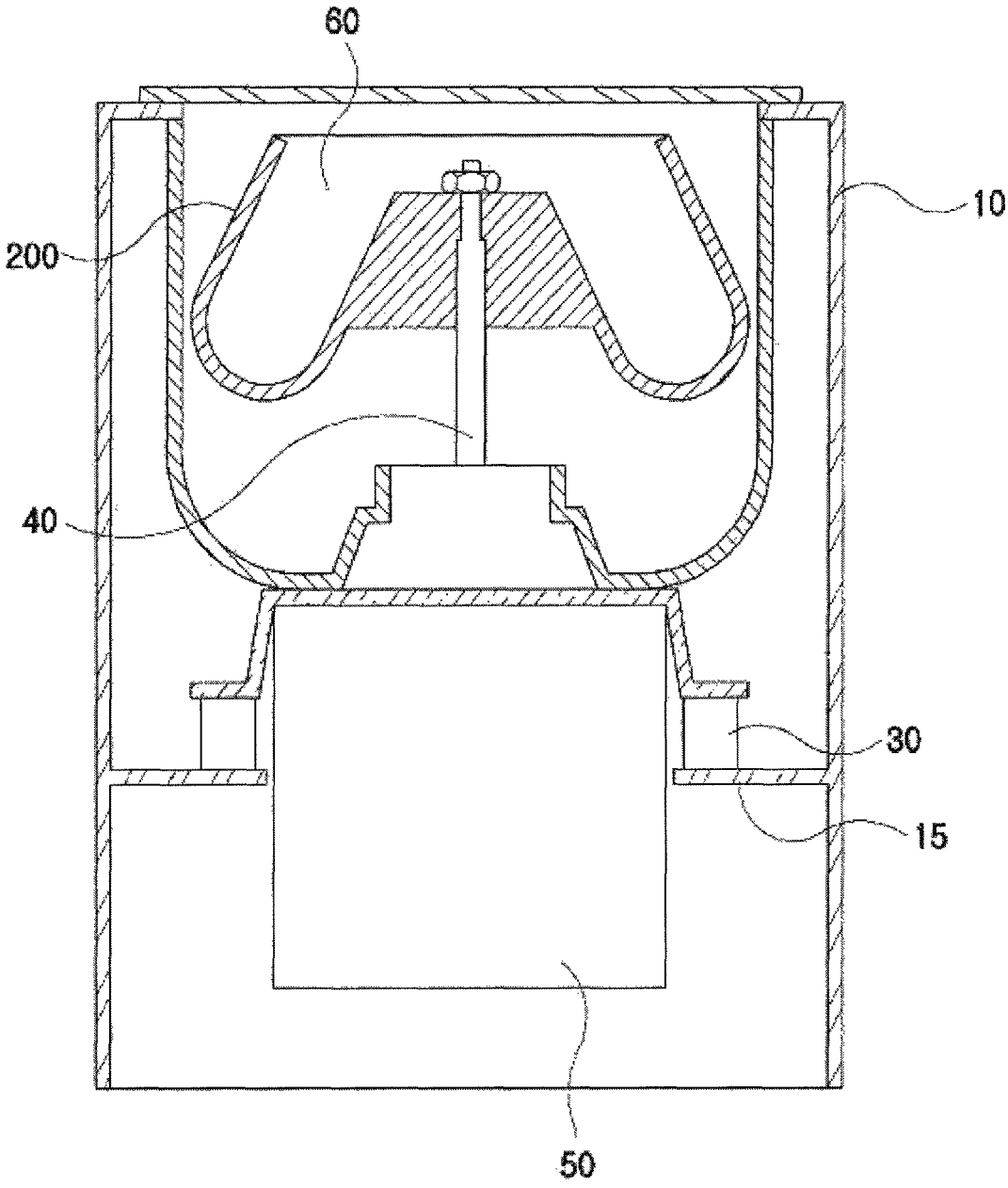
Related Art FIG. 1a
FIG. 1*a* is an exemplary embodiment of a conventional centrifuge (a fixed angle rotor type) and FIG. 1*b* is an exemplary embodiment of a conventional centrifuge (a swing-out rotor type).
Figure 1B:
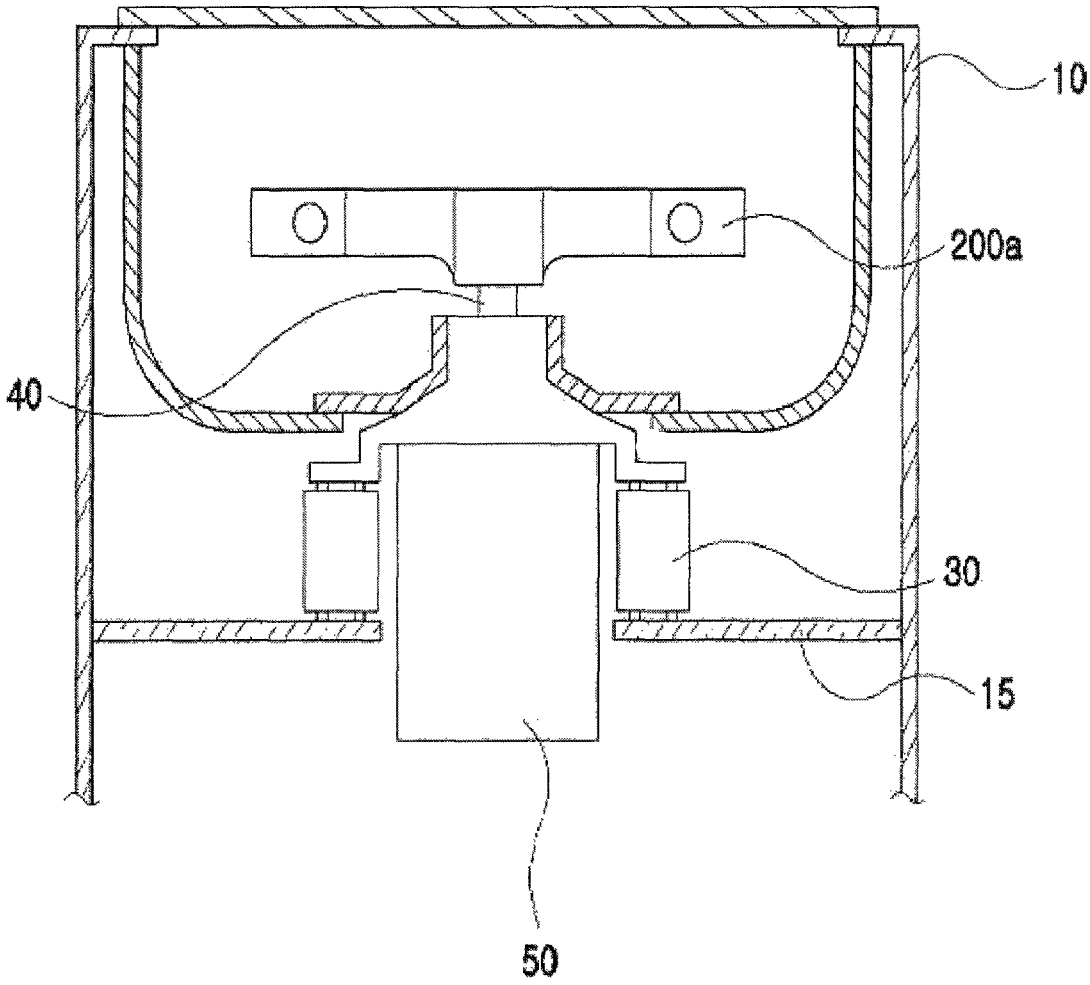
Related Art FIG. 1b

Hereinafter, the preferred embodiment of the present invention will be explained in detail with reference to the accompanying drawings.

As illustrated, a centrifuge using a balancer according to the present invention comprises a motor (50), a rotating shaft (40) of the motor projected from said motor, a rotor (200, 200*a*), and a balancer (100).

The following is the detailed description with reference to FIGS. 2*a* through 2*d*.

The centrifuge of the present invention comprises a supporting plate (15) formed at an inner surface of the outer case (10) and a rotor (200, 200*a*) that is mounted onto the rotating shaft of the motor projected from the motor (50) that is mounted to said supporting plate (15).

It is desirable that said motor (50) is supported by a cushioning member (30) such as a damper or rubber. Said cushioning member (30) plays a role to absorb a portion of the noise and vibration generated from the centrifuge due to the high-speed rotation of said motor (50).

Figure 2A:
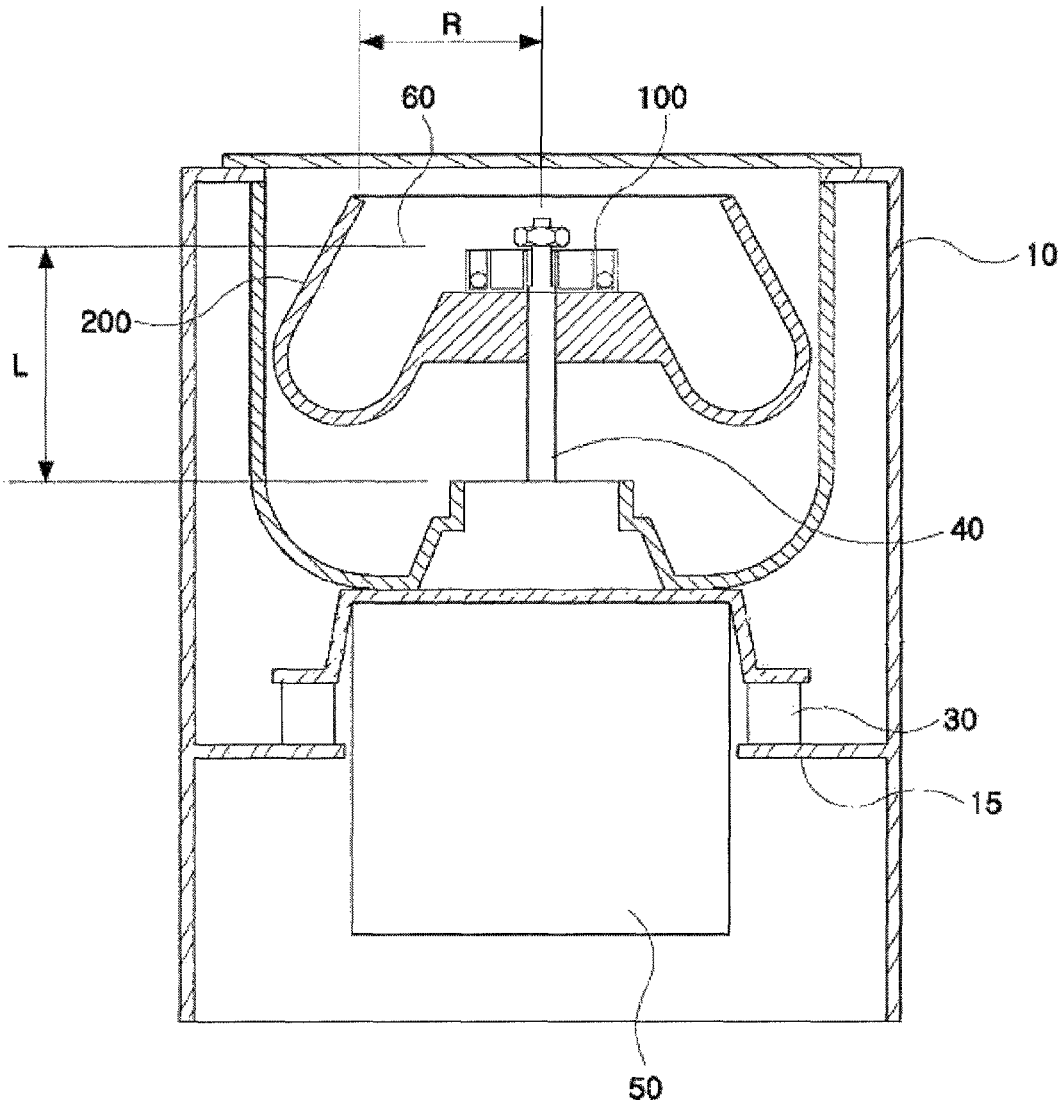
FIGS. 2*a* through 2*d* are sectional views illustrating exemplary embodiments of a centrifuge using a balancer according to the present invention.
Figure 2B:
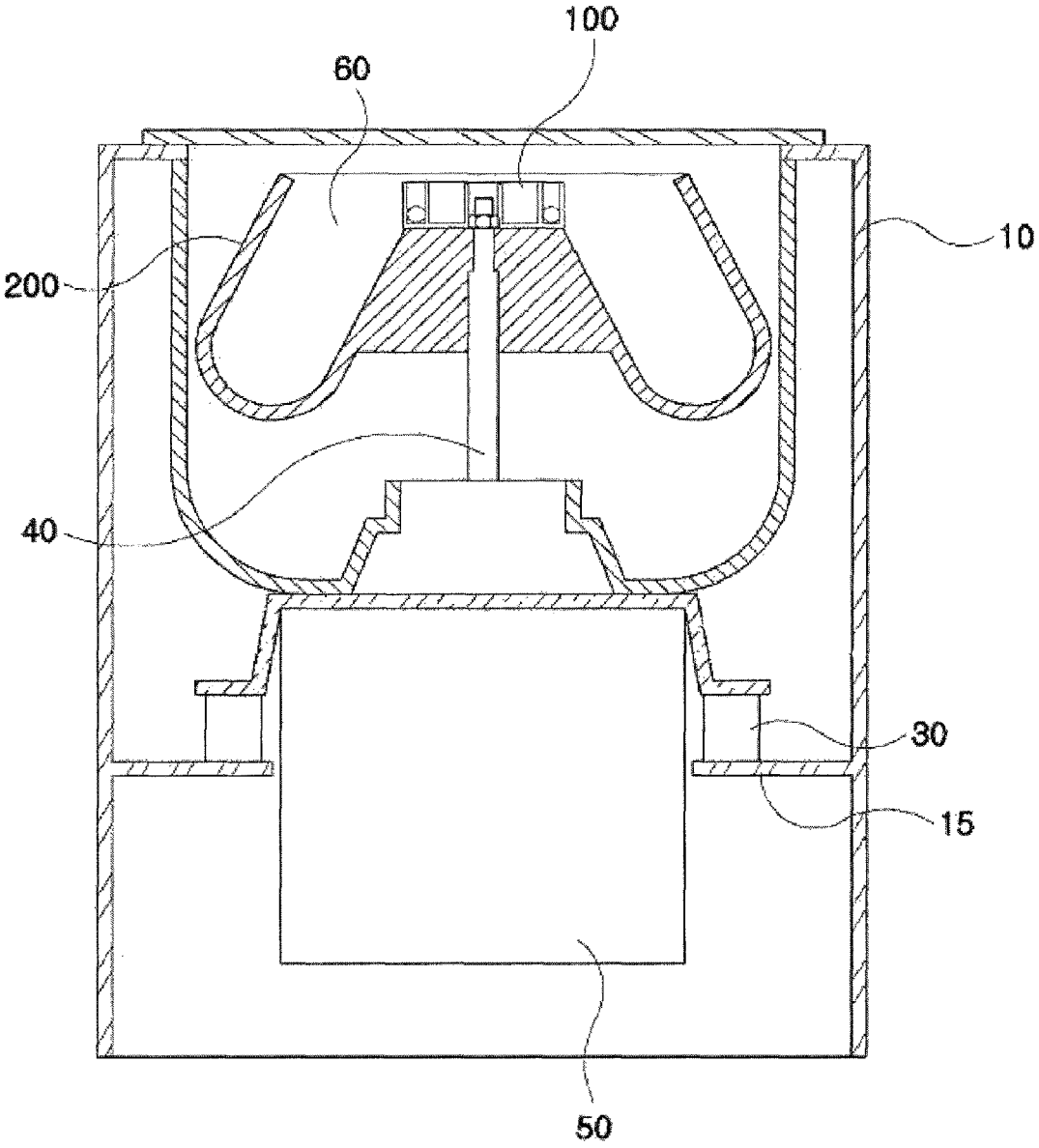
Figure 2C:
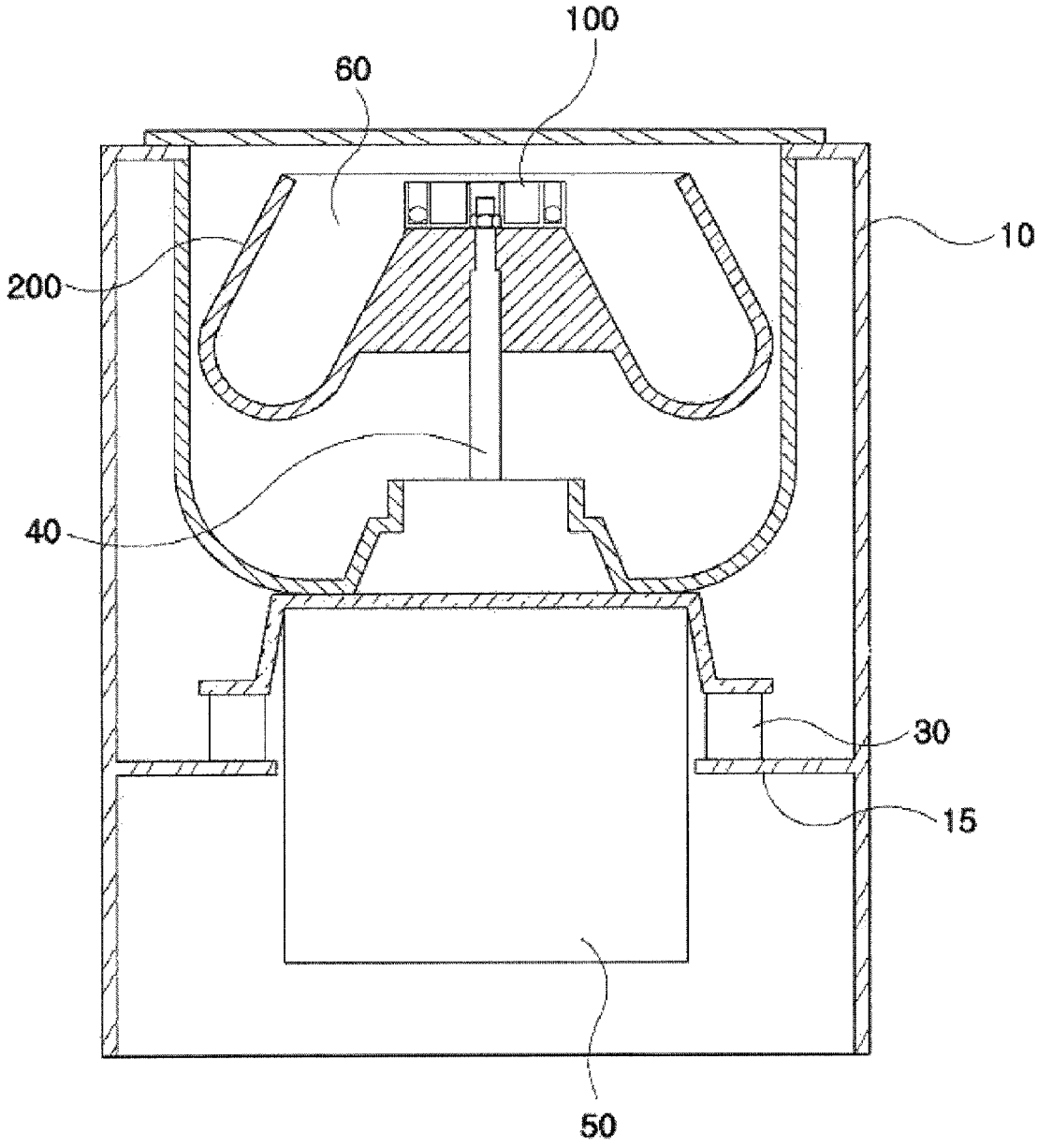

The rotating shaft (40) projected from said motor (50) is coupled with a fixed angle rotor (200) which is formed with a plurality of chambers (60). Those chambers (60) formed in said fixed angle rotor (200) are formed in such a way that the lower end (not shown) of said chamber is slanted outwardly from the center of said rotating shaft (40) of the motor, as illustrated in FIGS. 2*a* and 2*b*.

Figure 2D:
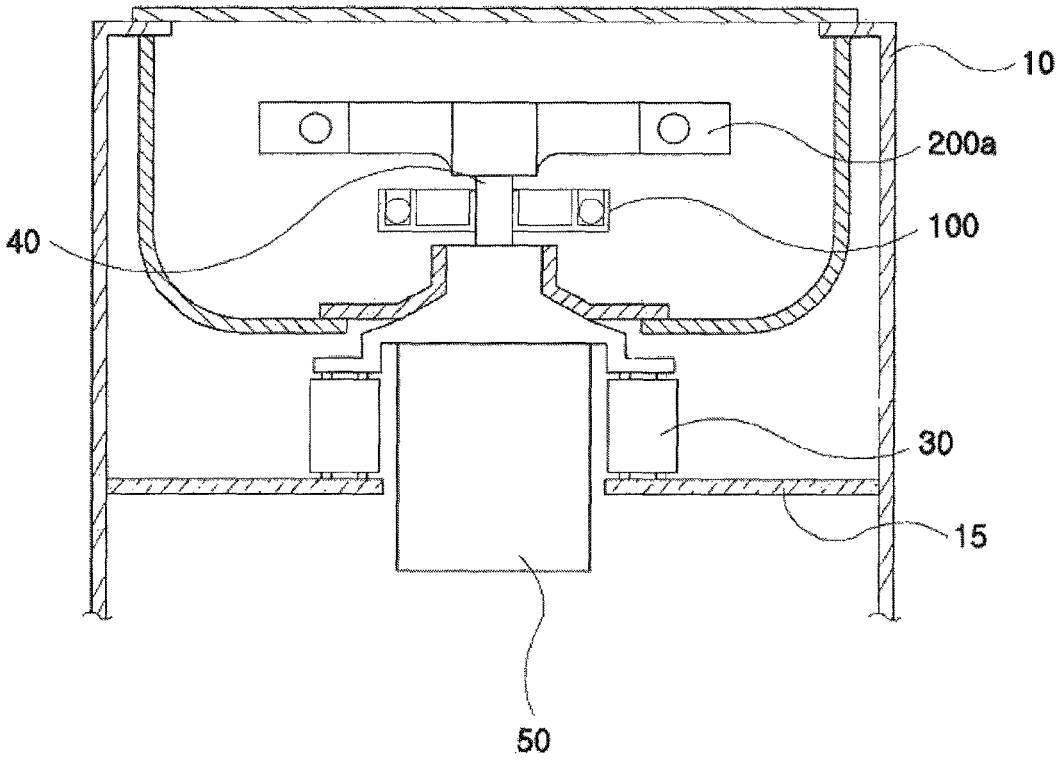
Figure 3A:
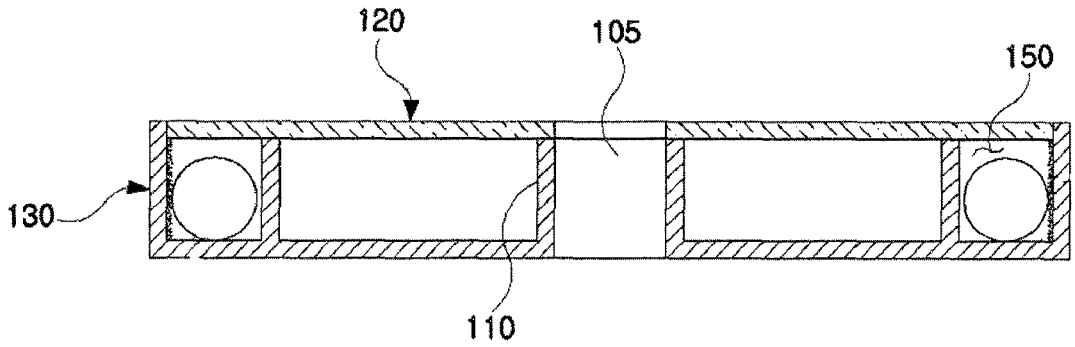
FIG. 3*a* is a sectional view illustrating an exemplary embodiment of a balancer according to the present invention.
Figure 3B:
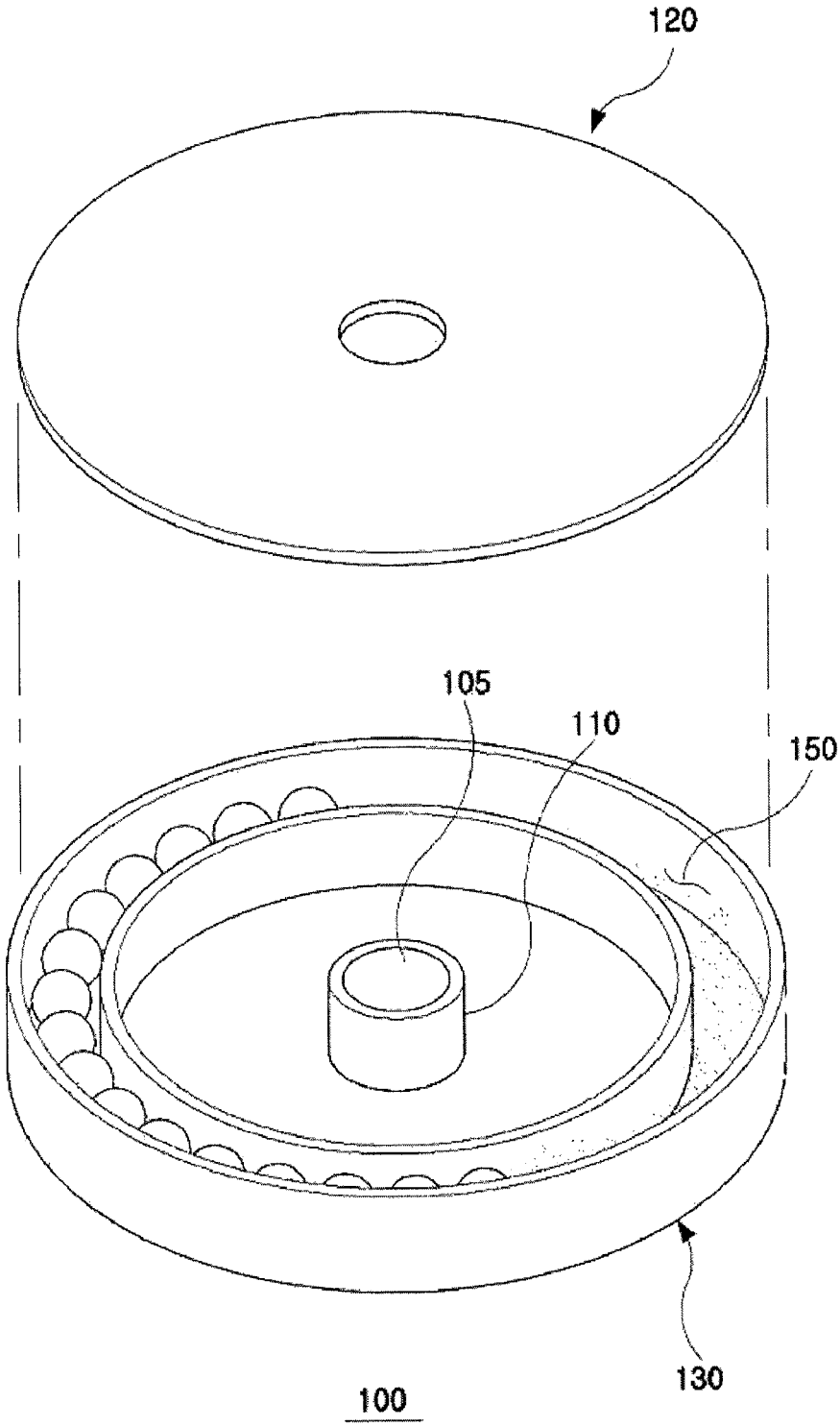
FIG. 3*b* is a perspective view of FIG. 3*a*.

Furthermore, in another embodiment, said centrifuge is configured to use a swing-out rotor (200*a*) as illustrated in FIG. 2*d*, wherein said swing-out rotor (200*a*) rotates perpendicularly to said rotating shaft (40) of the motor. Said swing-out rotor (200*a*) is configured in such a way that the buckets (not shown) in which the samples are loaded are hung by means of rings (not shown). In the centrifuge configured as above, a balancer (100) that is going to be described afterward is installed somewhere in said rotating shaft (40) of the motor or said rotor (200, 200*a*). Hereinafter, said balancer (100) will be described in detail with reference to FIGS. 3*a* and 3*b*.

As illustrated, the balancer (100) in accordance with the present invention comprises a cover (120) and a main body (130), wherein these two members are coupled to each other. Said cover (120) and said main body (130) can be coupled to each other by means of the interengaging grooves and projections (not shown) formed on the corresponding locations or screws (not shown). The coupling methods between these two members are well known and the detailed description thereof will be omitted.

In the center of said balancer (100), a connecting part (110) having a through-hole (105) to which a portion of said rotating shaft (40) of the motor or said rotor (200, 200*a*) is connected is provided.

Inside said balancer (100), a balancing space (150) of an annular shape is provided and compensation material is kept contained therein for balancing weight unbalance between the samples in the process of centrifugation. Said compensation material can be one of many different configurations such as solid, liquid, or a mixture of solid and liquid, and is not limited to any particular configuration. The amount of the compensation material stored in said balancing space (150) can be adjusted to an appropriate level depending on the operating conditions of centrifugation.

Figure 4:
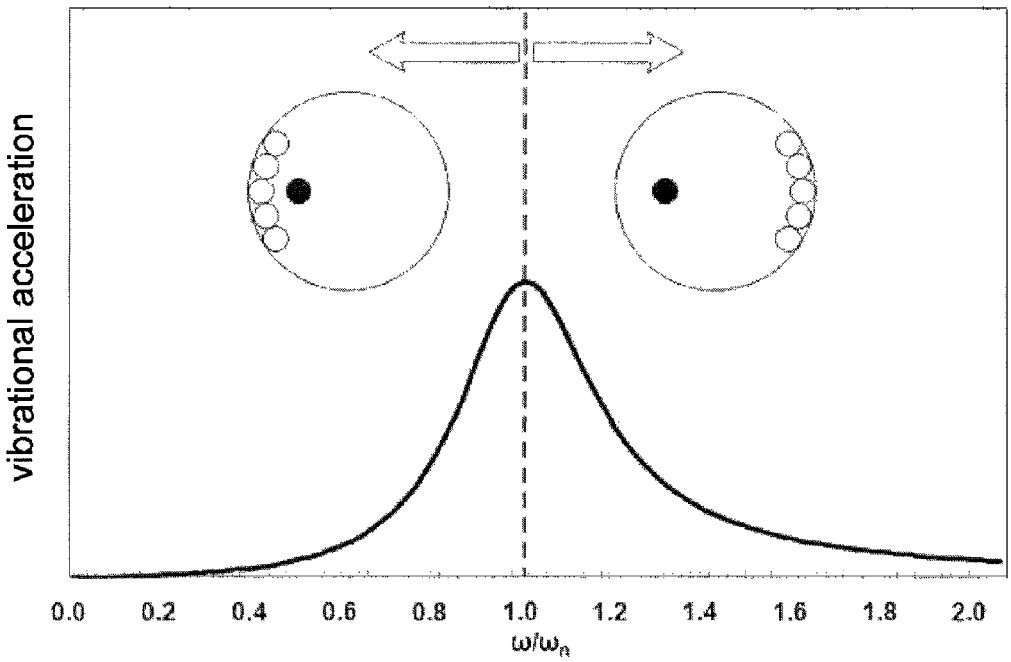
FIG. 4 is a graph illustrating a theoretical location of compensation material for the resonant speed.
Figure 5:
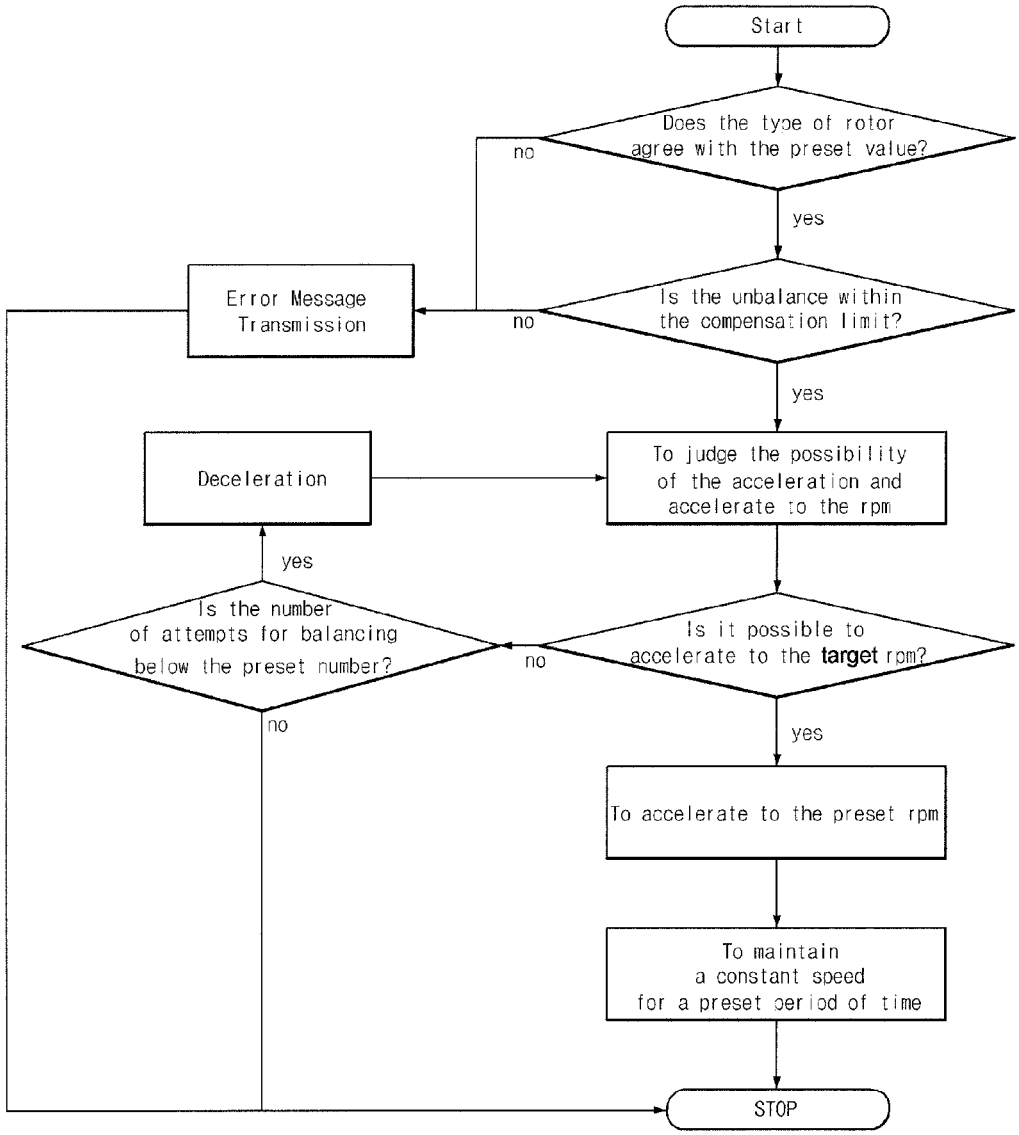
FIG. 5 is a flowchart for the control method of a centrifuge using a balancer in accordance with the present invention.

When the rotational speed of the rotor (W) is lower than the resonant speed ($W_n$), as illustrated in FIG. 4, said compensation material of the balancer is located on the same side as the unbalanced mass, thereby further increasing the overall unbalance and causing stronger vibration. When the rotational speed of the rotor exceeds the resonant speed, the compensation material moves to the opposite direction of the unbalance, achieving the balance and thus reducing the vibration. In general, it occurs on occasion that the ideal balancing cannot be achieved when the initial location for the unbalance of the compensation material contained in the balancer happens to be in the region where little movement of the compensation material occurs. Therefore, in case that an accurate balancing has not been achieved, as illustrated in FIG. 5, the balancing has to be executed again after the speed of the rotor has been reduced so that the accurate balancing can be achieved. Because the judgement on the balancing accuracy used in the process as above is executed during the low-speed rotation of the rotor and used as a basis to determine whether or not the acceleration is possible, the time for overall centrifugation can be saved, making the operation efficient.

It is efficient to setup a standard for judgement on the balancing accuracy based on the allowable vibrational acceleration or the unbalance amount according to the preset rotational speed. In other words, there exist the differences in the maximum allowable vibration value according to the preset rotational speed, and if the allowed vibrational acceleration is set too low, the number of attempts for balancing until the accurate balancing is achieved increases while if the allowed vibrational acceleration is set too high, excessive vibration is generated in the system, shortening the product life or causing the safety-related accidents.

Even in case that the rotor accelerates to the preset rotational speed or maintain a constant speed once it reaches the preset rotational speed after going through said judgement process on the balancing accuracy, it occurs on occasion that the vibration becomes greater because the balancing becomes broken due to various factors such as the irregular movement of the compensation material inside the balancer, the damage of the system, or the action of external forces.

Therefore, the damage to the equipment and the safety-related accidents can be prevented by setting the allowed vibration limit corresponding to each rotational speed of the rotor and stopping the rotation of the rotor in case that the allowable vibrational acceleration for the corresponding rotational speed is greater than the measured vibrational acceleration.

Figure 6:
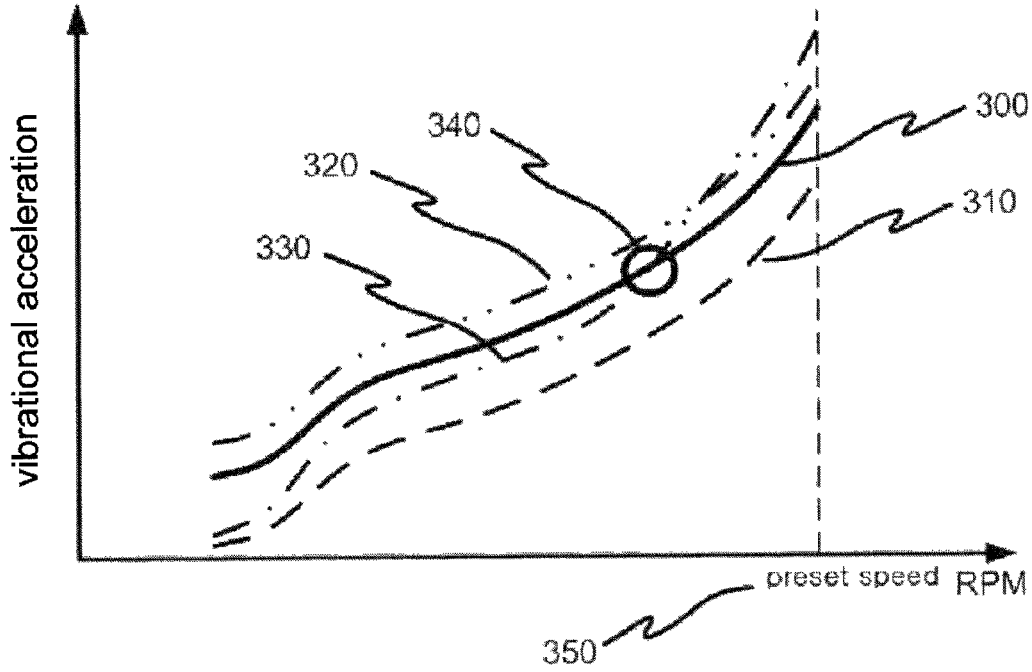
FIG. 6 is a graph illustrating an example of an allowed vibration range and various vibrational characteristic curves for the rotational speed.

FIG. 6 illustrates the allowed vibration limit (300) and the examples of various types of vibrational characteristic curves (310, 320, 330) for an arbitrarily set rotational speed (350). In case the preset rotational speed (350) represented by a solid line is changed to a new preset value, it is desirable to apply an allowed vibration limit that is appropriate for the newly preset speed. The characteristic curve (310) represented by a dotted line where the allowed vibration limit is not exceeded at all during the acceleration from the low speed to the preset speed is the case where the acceleration to the preset speed is possible. For the characteristic curve (320) represented by a dot-dot-dash line where the vibration level is higher than the allowed vibration limit already from the low speed, the acceleration must be stopped and it is safe to execute the balancing again after reducing the speed. The characteristic curve (330) represented by a dot-dash line which intersects with the allowed vibration limit curve shows that the allowed vibration limit is exceeded from the intersecting point (340) through the preset speed. In other words, for such a characteristic (330), the speed should be reduced at the point where two curves intersect before executing the balancing again. Or another control to be considered could be that before reducing the speed, the vibration characteristic is a little further observed for a certain period of time after the intersecting point appears.

The allowed vibration according to said rotational speed becomes different depending on the vibration characteristic of the system, and this vibration characteristic is different for different rotor type in use. In general, the centrifuge uses a method that the user enters into the system the type of rotor mounted, and the preset rotational speed entered according to the rotor type entered and the maximum allowed vibrational acceleration for each rotational speed are used as the standard for judgement on the excessive vibration. In case that said entered rotor is different from the type of the rotor actually installed, there occurs a problem that the system recognizes the incorrect information of the allowed vibrational acceleration. Therefore, it is needed to identify the type of the rotor actually mounted, and by utilizing the fact that different type of rotor has different resonant speed, measuring the vibrational acceleration during the acceleration of the rotor and then comparing the resonant speeds can identify the type of the rotor installed. In case that the information of the rotor entered is different from the one of the rotor in actual use, the operator is notified of it and the rotation should be stopped in order to confirm the type of the rotor and correct it for the stable use of the centrifuge.

The centrifuge using said balancer has the maximum compensable unbalance determined and in case that the samples are loaded with the unbalance that exceeds the compensable mass, no balancing can be achieved. Therefore, the vibrational acceleration becomes greater in case the unbalance exceeds the compensable limit than the unbalance is smaller that the compensable limit, and if it is possible to sense it in advance, the number of unnecessary attempts of balancing can be reduced, saving the time needed for centrifugation. In order to accomplish said object, if the vibration level is greater than the one for the case that the amount of the unbalance load is same as the allowed compensation limit, it is possible that the excess of the allowed compensable mass is notified and the centrifugational operation is stopped.

The accurate balancing can be obtained by controlling the acceleration of the rotor of the centrifuge using said balancer. As illustrated in FIG. 4, the balancing is achieved as the compensation material moves to the opposite direction of the unbalance by the vibration and phase change generated when the rotational speed of the rotor passes the resonance region. Therefore, in case that the rotational speed of the rotor passes the resonance region quickly, the compensation material cannot move to the opposite direction of the unbalance sufficiently. In this case, by reducing the rotational acceleration of the rotor or maintaining a constant speed for a certain period of time in the resonance region, the compensation material moves to the opposite direction of the unbalance accurately.

(1) The noise and damage to the equipment caused by the unbalance and high-speed rotation of the rotor can be prevented in advance because it is decided before the high-speed rotation of the rotor whether or not the acceleration is possible, based on the judgement on the balancing accuracy.

(2) The probability of the balancing failure can be lowered and the centrifugation time can be saved because the target rotational speed and the unbalance amount are compared to determine whether or not the acceleration of the rotor is possible.

(3) In case that the maximum compensable unbalance is exceeded, a prior warning is provided during the low speed interval and the operation is stopped, reducing the number of unnecessary attempts for balancing and thus saving the centrifugation time.

(4) The excessive vibration that could be generated during the high-speed rotation of the rotor is promptly interpreted and the rotor is stopped, preventing the noise that could be generated due to the excessive vibration and the damage to the equipment.

(5) Because the type of rotor is checked in advance during the low-speed interval and compared with the entered setting of rotor type to identify any error in setting, the control error caused by the incorrect setting is prevented in advance, saving the centrifugation time and preventing the safety-related accidents.

(6) Because the rotating speed of rotor is decelerated or maintained a constant speed for a certain period of time during the resonance interval where the vibration is strong, an excellent effect of balancing is achieved.

What is claimed is:

1. A control method for a centrifuge which comprises a motor, a rotating shaft of the motor projected from said motor, a rotor connected to said rotating shaft of said motor and a balancer, wherein said balancer has a balancing space formed by a main body which has a space of an annular shape therein and a cover which is coupled to said main body and said balancing space contains a material which acts as a compensation mass, said control method comprising:

accelerating said rotor to any preset rotational speed;

measuring a vibration magnitude of said rotor;

analyzing said vibration magnitude measured in said measuring step judging whether or not said rotor can accelerate;

reducing a rotor speed below a resonant speed if said rotor cannot accelerate; and accelerating said rotor seed to a preset speed if said rotor can accelerate.

2. The control method according to claim 1, wherein the steps of accelerating, measuring, analyzing, and judging are repeated after having said motor stopped, if said vibration magnitude is greater than a preset vibration magnitude after the steps of accelerating, measuring, analyzing, and judging.

3. The control method according to claim 1, wherein for the step, judging whether or not said rotor can accelerate, a vibrational acceleration or unbalance amount that does not cause any damage of the centrifuge and reduction of lifetime is individually judged for said preset rotational speed and compared with the vibrational acceleration or the unbalance amount as a standard for judgement on whether or not said acceleration is possible.

4. The control method according to claim 1, wherein for the step, judging whether or not said rotor can accelerate, if an unbalance amount exceeds an allowed limit of mass compensation, an operation of the centrifuge is stopped and a warning is given.

5. The control method according to claim 1, further including the step of judging whether or not the centrifuge has to be interrupted by using a vibrational acceleration or an unbalance amount.

6. A control method for a centrifuge which comprises a motor, a rotating shaft of the motor projected from said motor, a rotor connected to said rotating shaft of the motor, and a balancer, wherein said balancer has a balancing space formed by a main body which has a space of an annular shape therein and a cover which is coupled to said main body, and said balancing space contains a material which acts as a compensation mass, the method comprising:

calculating a resonant frequency when said rotor rotates by a resonant speed; and controlling a magnitude of a rotational speed in accordance with characteristics of the rotor.

7. The control method according to claim 6, further comprising:

stopping a rotation of said rotor, if a type of said rotor identified by said resonant frequency is different from a type of said rotor entered into the centrifuge.

8. A control method for a centrifuge which comprises a motor, a rotating shaft of the motor projected from said motor, a rotor connected to said rotating shaft of said motor, and a balancer, wherein said balancer has a balancing space formed by a main body which has a space of an annular shape therein and a cover which is coupled to said main body, and said balancing space contains a material which acts as a compensation mass, the method comprising:

reducing a rotational acceleration of said rotor or maintaining a speed of said rotor at a constant speed for a certain period of time when a phase of said rotor and a vibration of said rotor change and the compensation mass moves to an opposite direction of an unbalance in order to resolve the unbalance.

* * * * *